US008884523B2

(12) United States Patent
Winterhalter et al.

(10) Patent No.: US 8,884,523 B2
(45) Date of Patent: Nov. 11, 2014

(54) DRIVING AT LEAST TWO HIGH FREQUENCY-POWER GENERATORS

(75) Inventors: Markus Winterhalter, Bad Krozingen (DE); Ekkehard Mann, Gundelfingen (DE)

(73) Assignee: TRUMPF Huettinger GmbH + Co. KG, Freiburg (DE)

( * ) Notice: Subject to any disclaimer, the term of this patent is extended or adjusted under 35 U.S.C. 154(b) by 2107 days.

(21) Appl. No.: 11/934,901

(22) Filed: Nov. 5, 2007

(65) Prior Publication Data

US 2008/0105538 A1 May 8, 2008

(30) Foreign Application Priority Data

Nov. 4, 2006 (DE) ..... 10 2006 052 061

(51) Int. Cl.
*H05B 31/26* (2006.01)
*H05H 1/46* (2006.01)

(52) U.S. Cl.
CPC ..... *H05H 1/46* (2013.01)
USPC ..... 315/111.21; 315/111.51; 315/111.81

(58) Field of Classification Search
USPC ..... 315/111.21–111.91, 261, 326, 341; 204/192.1, 298.01–298.08, 298.31, 204/298.34; 156/345; 118/723 I, 723 R
See application file for complete search history.

(56) References Cited

U.S. PATENT DOCUMENTS 4,863,549 A * 9/1989 Grunwald ..... 156/345.44
5,057,185 A * 10/1991 Thomas et al. ..... 438/710
5,087,857 A 2/1992 Ahn
5,314,603 A 5/1994 Sugiyama et al.
5,565,737 A * 10/1996 Keane ..... 315/111.21
5,698,062 A 12/1997 Sakamoto et al.
5,770,922 A 6/1998 Gerrish et al.
5,824,606 A 10/1998 Dible et al.
5,844,369 A * 12/1998 Yoshizako et al. ..... 315/111.21
5,928,528 A 7/1999 Kubota et al.
5,935,373 A * 8/1999 Koshimizu ..... 156/345.28
6,046,641 A 4/2000 Chawla et al.
6,060,837 A * 5/2000 Richardson et al. ..... 315/111.51
6,214,162 B1 * 4/2001 Koshimizu ..... 156/345.28
6,411,490 B2 6/2002 Dible
6,417,732 B1 7/2002 Radomski et al.

(Continued)

FOREIGN PATENT DOCUMENTS

DE 4122624 1/1993
DE 4322608 1/1995

(Continued)

OTHER PUBLICATIONS

Office Action from corresponding German Application No. DE 10 2006 052 061.0-54, mailed Sep. 17, 2007 by the German Patent office, 6 pages.

(Continued)

*Primary Examiner* — Tung X Le
(74) *Attorney, Agent, or Firm* — Fish & Richardson P.C.

(57) ABSTRACT

For driving at least two HF power generators that supply a plasma process with HF power, at least one drive signal is generated and at least one pulse signal is generated. Then, based on the at least one drive signal and the at least one pulse signal, a pulsed HF power signal is generated by each of the at least two HF power generator.

25 Claims, 5 Drawing Sheets

(56) References Cited

U.S. PATENT DOCUMENTS

| | | | | |
|---|---|---|---|---|
| 6,471,732 | B1 | 10/2002 | Shimada | |
| 6,472,822 | B1 | 10/2002 | Chen et al. | |
| 6,673,724 | B2 | 1/2004 | Forster et al. | |
| 6,849,154 | B2 | 2/2005 | Nagahata et al. | |
| 6,917,204 | B2 | 7/2005 | Mitrovic et al. | |
| 7,602,127 | B2 * | 10/2009 | Coumou | 315/111.21 |
| 2003/0046013 | A1 * | 3/2003 | Gerrish | 702/60 |
| 2003/0215373 | A1 | 11/2003 | Reyzelman et al. | |
| 2006/0232471 | A1 | 10/2006 | Coumou | |
| 2009/0315463 | A1 | 12/2009 | Coumou | |

FOREIGN PATENT DOCUMENTS

| | | |
|---|---|---|
| DE | 10309711 | 9/2004 |
| EP | 1 134 773 | 9/2001 |
| EP | 1589793 | 10/2005 |
| JP | 5-205898 | 8/1993 |
| JP | 0673912 | 10/1994 |
| JP | 10326698 | 12/1998 |
| JP | 2001156006 | 6/2001 |
| JP | 2001-274099 | 10/2001 |
| JP | 2003257699 | 9/2003 |
| JP | 2003-532986 | 11/2003 |
| JP | 2005123654 | 5/2005 |
| JP | 2005130198 | 5/2005 |
| JP | 2006216679 | 8/2006 |
| JP | 2006304585 | 11/2006 |
| KR | 1998-0012069 | 4/1998 |
| KR | 2000-0011902 | 2/2000 |
| KR | 2002-0077649 | 10/2002 |
| WO | WO 2004/064460 | 7/2004 |

OTHER PUBLICATIONS

English Translation of Office Action from corresponding German Application No. DE 10 2006 052 061.0-54, mailed Sep. 17, 2007 by the German Patent office, 5 pages.

English Translation of Office Action from corresponding Japanese Application No. 2006-218807, mailed Feb. 20, 2009, 7 pages.

Translation of the Notification of Reasons for Refusal and Rejection of Amendment for corresponding Japanese Application No. 2007-287606, dispatched Feb. 5, 2010, 10 pages total.

English translation of Japanese Office Action for corresponding Japanese Patent Application No. 2007-287606, mailed Jul. 29, 2009, 38 pages.

Analog Devices, Preliminary Technical Data, AD9952, Direct Digital Synthesizer, 400 MSPS 14-Bit, 1.8V CMOS, Analog Devices, Inc., 2002.

Translation of Japanese Office Action for Japanese Application No. 2006-218807, mailed Jul. 29, 2009, 7 pages.

Notice Requesting Submission of Opinion in Korean Application No. 10-2006-0075704, mailed Feb. 29, 2008, with translation.

* cited by examiner

DRIVING AT LEAST TWO HIGH FREQUENCY-POWER GENERATORS

CROSS REFERENCE TO RELATED APPLICATION

This application claims priority under 35 U.S.C. §119(a) to German Patent Application DE 10 2006 052 061.0, filed Nov. 4, 2006, the contents of which are hereby incorporated by reference.

TECHNICAL FIELD

The invention relates to driving at least two high-frequency (HF) power generators, which supply a plasma process with HF power, and more particularly, to driving at least two HF power generators based on at least one drive signal.

BACKGROUND

HF plasma processes are used, for example, for etching, coating, and ashing of relatively small areas. In plasma processes, however, increasingly larger areas are to be treated, for example, larger wafers in the semiconductor industry, or larger flat-panel displays. While it has so far been relatively easy to produce a homogeneous plasma over the area processed, the dimensions of areas that now need coating or etching extend into the range of the wavelength of the excitation signals of the plasma, or of the harmonics of the excitation signals. Thus, wave-like structures are produced in the plasma, and homogeneous plasma processing becomes difficult.

To counteract wave-like structures, it is known to use several HF plasma generators, which are operated at different or equal frequencies. In U.S. Pat. No. 5,698,062 for example, a HF power generator drive system is disclosed that incorporates a low-voltage source and a frequency divider. The frequency divider drives two HF amplifiers, which can also be considered as HF power generators. The HF amplifiers feed HF power into the plasma process at various points.

U.S. Pat. No. 5,824,606 discloses a method for driving two HF power generators with the same frequency and using these HF power generators to feed HF power into the plasma process at various points. Using a phase-shifter, one adjusts the phase position between the output signals of the HF power generators.

U.S. Pat. No. 6,673,724 B2 describes an arrangement, in which a first signal generator generates a first signal for a first electrode using a DC-voltage supply and a first signal waveform modulator, and a second waveform generator generates a second signal for a second electrode of a plasma chamber using an HF power generator and a second signal waveform modulator.

In experiments for flat panel display manufacturing, medium frequencies (MF) are studied to excite plasma (10 kHz to 1 MHz). To this end, multiple pairs of electrodes are arranged in immediate proximity to further pairs of electrodes. Each pair of electrodes is supplied by a MF generator. The MF generators do not run synchronously and not necessarily with the same frequency.

SUMMARY

The method and the system described herein enable a flexible supply of power to different electrodes of a plasma chamber.

In general, in a first aspect, the invention features a method for supplying a plasma process with HF power that includes providing at least two HF power generators, generating at least one drive signal, generating at least one pulse signal, and based on the at least one drive signal and the at least one pulse signal, generating a pulsed HF power signal by each of the at least two HF power generators.

In another aspect, a method for generating a pulsed HF power signal for supplying a plasma process with HF power includes providing at least two HF power generators, providing at least one drive signal, providing at least one pulse signal, and based on the at least one drive signal and the at least one pulse signal, generating the pulsed HF power signal by each of the at least two HF power generators.

In another aspect, a HF power generator drive system includes at least three signal generating arrangements for generating drive and pulse signals, wherein the at least three signal generating arrangements include at least one drive-signal generating arrangement for generating at least one drive signal, and at least one pulse-signal generating arrangements for generating a pulse signal.

Implementations may include one or more of the following features. The method can further include adjusting at least one parameter for the at least one pulse signal. Examples of parameters include a pulse-frequency parameter, a duty-cycle parameter, and a phase-position parameter, can be selected. Alternatively, or additionally, a phase relationship and/or a frequency relationship of the pulse signals assigned to different HF power generators can be adjusted.

In some embodiments, a pulse frequency of the pulsed HF power signal of one of the HF power generator is smaller than a frequency of the drive signal assigned to the same HF power generator.

In some embodiments, a pulse frequency of one of the HF power generators is set synchronously or asynchronously to a frequency of the drive signal assigned to the same HF power generator.

In some embodiments, for each HF power generator a drive signal is generated.

In some embodiments, at least two drive signals are generated, and a phase- and/or frequency relation of at least two of the drive signals to each other is set.

In some embodiments, at least two drive signals and/or pulse signals have different frequencies.

In some embodiments, the at least one drive signal and/or the at least one pulse signal can be adjusted via at least one digital interface of a HF power generator drive system. Alternatively, or additionally, the at least one drive signal and/or the at least one pulse signal can be adjusted via a programmable logic component. In some embodiments, the method can further include selecting a frequency of the at least one drive signal to be an integral multiple of a frequency between 1 MHz and 6 MHZ.

In some embodiments, at least one drive signal and/or the at least one pulse signal can be each generated using a function generator. The function generator can be driven by a common clock frequency.

In some embodiments, at least one of the three signal generating arrangements of the HF power generator drive system can include a digital function generator, for example, a direct digital synthesizer. Alternatively, or additionally, at least one of the three signal generating arrangements can include a filter device connected to a load side of the digital function generator. Alternatively, or additionally, at least one of the at least three signal generating arrangements can include a comparator generating the respective drive signal or pulse signal.

In some embodiments, the HF power generator drive system can include a processor for driving at least one of the at least three signal generating arrangements. For example, the processor can generate one or more pulse signals.

In some embodiments, the HF power generator drive system can include an oscillator for generating a clock signal, which is connected to at least one of the at least three signal generating arrangements and/or the processor.

In some embodiments, the HF power generator drive system can include a programmable logic component.

In some embodiments, an arrangement for HF plasma excitation can include a HF power generator drive system as described above and at least two HF power generators, connected to and driven by the HF power generator drive system.

In another general aspect of the method, at least one pulse signal is generated, and a pulsed HF power signal is generated by each HF power generator using one drive signal and one pulse signal, respectively. This makes it possible to supply a range of electrodes, which are each connected to one HF power generator, with power signals that can be almost arbitrarily adjusted. Using the drive signal, which can switch one or more switching elements of the HF power generator, it is possible to adjust, for example, the signal waveform and/or the frequency of a HF power signal output by a HF power generator. By means of the pulse signal the HF power signal can be pulsed. This can be achieved by the drive signal already being pulsed, that is to say quasi switched on and off in dependence on the pulse signal. The pulse behavior of the pulsed HF power signal can be adjusted by means of the pulse signal. Hence, a user can have a multitude of parameters at his disposal for controlling the power supplied to a plasma process. One can, in principle, generate the same drive signal for all HF power generators and generate different pulse signals for the HF power generators. On the other hand one can generate for each HF power generator its own drive signal and use the same pulse signal for all HF power generators.

In some embodiments, a pulse signal is generated for each HF power generator. It thereby can be possible to generate differently pulsed HF power signals at the output of each HF power generator.

Additional flexibility in generating pulsed HF power signals can be achieved when the pulse frequency and/or the duty cycle and/or the phase position of one or several pulse signals are adjusted. In this way, a multitude of possibilities can be available for influencing the power in a plasma process. The duty cycle can for instance be adjusted over the range 0-100%.

It is particularly advantageous if the phase relationship and/or a frequency relationship of pulse signals associated with different HF power generators can be adjusted. In this way, an optimal and tuned supply of power for a plasma process can take place via different electrodes. This also enables the pulse signals to be synchronized when necessary. For example, the pulse signals can be generated with the same frequency, however, being phase-shifted relative to one another. They can be, for example, in phase, in anti-phase, or in any arbitrary phase relation to one another. Moreover, at least two pulse signals can have different frequencies. The frequencies can be arbitrarily chosen, or stand in a particular mathematical relationship to one another.

Some embodiments can have the characteristic that the pulse frequency is smaller than the frequency of the drive signal assigned to the same HF power generator. For example, the pulse frequency can be chosen in the range of 1 Hz-1 MHz and the frequency of the drive signal in the range of 10 kHz-300 MHz.

Alternatively, or additionally, the pulse frequency can be set synchronously or asynchronously to the frequency of the drive signal assigned to the same HF power generator. For example, the pulse signal and the drive signal can be tuned to one another in such a way that the drive signal is pulsed only at the beginning or at the end of a complete period of the drive signal. For example, the rising and/or falling edges of the pulse signal can be adjusted to only occur at a zero-crossing of the drive signal.

A drive signal can be generated for each HF power generator. Thus, a particularly flexible supply of power into the plasma process can take place.

In some embodiments, the drive signals and/or the pulse signals can be each generated using a function generator, especially a digital function generator, and preferably a digital sine-wave generator. By using digital function generators, that are each individually adjustable, it is possible to generate virtually arbitrary drive signals and/or pulse signals when generating the drive signals and/or pulse signals. In particular, the frequency and phase position of each individual drive signal and/or pulse signal, as well as various relationships of the different drive signals and/or pulse signals can be adjusted relative to one another. Thus, the HF power feed into the plasma process can be adjusted and varied in an intended way. It thus becomes possible to generate a suitable combination of drive signals and/or pulse signals for different HF power generators, so that it then becomes possible to homogenize the plasma even when coating a large surface area, or in etching processes for large areas. In the context of this disclosure, "high frequency" is understood to mean a frequency in the range of 10 kHz-300 MHz.

In some embodiments, a phase and/or frequency relationship between the drive signals can be set. Then, various scenarios are possible and can depend on the area of application.

For example, the pulse signals can be generated with the same frequency but with each pulse signal being phase-shifted relative to another one. By this method, for example, the voltage difference between two electrodes can be adjusted. This can influence the impedance of the HF power generators at their outputs, the output power for a given DC-voltage, the arcing behavior and the amount of ion energy in the plasma.

It is further possible that at least two drive signals and/or pulse signals have different frequencies. In this way, the frequencies can be arbitrarily chosen, or can stand in a particular mathematical relationship to one another. For example, the frequencies can be chosen as multiples of a fundamental frequency. Thus, synchronization of the drive signals is possible.

The adjustment of the drive signal(s) and/or the pulse signal(s) can preferably take place via at least one digital interface of the HF power generator drive system. It can thereby be provided that multiple function generators can be influenced by means of a single interface. An interface can also be provided for each function generator.

The adjustment of the drive signals and/or the pulse signals can take place via a programmable logic component, such as, for example, a field programmable gate array (FPGA) or a processor.

If the frequencies of the control signals are chosen to be integer multiples of a fixed frequency in the range 1-6 MHz, especially as integer multiples of 3.39 MHz, the method can be used in etching processes. Multiplication of the frequency of 3.39 MHz by the factor 4 arrives at the ISM (Industrial, Scientific, and Medical)-frequency of 13.56 MHz, and multiplication by the factor 8 at the ISM-frequency of 27.12 MHz. Using the inventive method it is thereby possible to generate one drive signal at one ISM-frequency and another drive signal at another multiple of the frequency 3.39 MHz. It is advantageous if the clock frequency is an integer multiple of the ISM-frequency 13.56 MHz, so that ISM-frequencies can be easily set.

It is advantageous if the digital frequency generators are driven by a common clock frequency, which allows setting the frequency and phase relationship between two drive signals in a particularly simple way. It is further possible that also a processor that drives the function generators is likewise supplied with the common clock frequency, so that it is guaranteed that data from the processor is acquired synchronously by the function generators.

In another aspect, an HF power generator drive system for driving at least two HF power generators feeding a plasma process with HF power includes at least one drive signal generating arrangement for generating at least one drive signal, and at least two pulse generating arrangements for generating a pulse signal respectively are provided or at least two control signal generating arrangements and at least one pulse signal generating arrangement are provided. In this way, the homogeneity of a plasma can be adjusted almost arbitrarily.

A high degree of integration results when the pulse signal generating arrangement(s) are positioned within the drive system.

In some embodiments, the drive signal and/or pulse signal generating arrangements can each have a digital function generator, especially a sine-wave generator. Such an arrangement enables a wide variety of drive signals to be generated. In particular, the phase and frequency of each individual signal can be freely adjusted. This results in multiple ways for influencing the HF power generators and thereby the plasma process. One can use, for example, the AD9959 from Analog Devices, which contains four integrated digital function generators.

Moreover, the function generator can be constructed in the form of a Direct Digital Synthesizer (DDS). With a DDS, a step-shaped sinusoidal signal can be generated. The phase setting can thereby be essentially freely adjusted. The frequency can likewise be adjusted over a wide range depending on the capability of the DDS.

The drive signal and/or pulse signal generating arrangements can have a filter device downstream of the digital function generator. The output signal of the digital function generator can be step-shaped; in particular, it can have a step-shaped sinusoidal form. If such a signal is passed to a filter device, the form can be smoothed, so that an analogue sinusoidal signal is formed. Certain HF power generators can be driven with such a sine-wave signal.

In order to generate a drive signal, or a pulse signal, for newer generation HF power generators, it is advantageous when the drive signal and/or pulse signal generating arrangements have a comparator that generates the respective drive signal or pulse signal. By using a comparator, for example, a square-wave signal can be generated from a smoothed sine-wave signal, and the HF power generator can be driven using the square-wave signal. The function generator can include a comparator, so that the digitized sine-wave signal is initially passed to a filter device where it is smoothed, and the signal obtained there is again transmitted to the function generator, where it is fed to the comparator of the function generator.

A processor for driving the drive signal and/or pulse signal generating arrangements can be provided. This gives rise to the possibility of programming the function generators of the signal generator arrangements in a purposeful way. The processor can be controllable and/or programmable via one or more interfaces. A processor (the same one or another) can also be a component of the pulse signal generating arrangements, when it generates the pulse signals.

Synchronization becomes possible if an oscillator is provided for generating a clock signal. The oscillator can be connected to the signal generating arrangements and/or the processor.

In some embodiments, at least one interface, for example, a digital interface and/or user interface (operator panel), can be provided. It thereby becomes possible, especially via the processor, to access the function generators. Thus, for example, the frequency or the phase can be modified by a user in a given range. With the aid of such interfaces, it is moreover possible to perform automatic regulation of the drive signals and/or the pulse signals, especially of the frequencies and phase positions of the signals. At least two signal generator arrangements can be controllable by one interface. Both of the signal generator arrangements are thereby controllable and can be adjusted both in frequency and in phase, in each case independently of or dependent on each another.

In addition to or as an alternative to the processor, the HF power generator drive system can have a programmable digital logic component, especially a FPGA, which is connected to the interface(s) and/or to the signal generator arrangements, wherein the digital logic component can take the form of a processor. In particular, at least one pulse signal and at least one drive signal can be supplied to it. In this case, the logic component can synchronize the signals.

In some embodiments, the HF generators can be synchronized and the phase of the individual generators can be adjusted.

In some embodiments, high voltages and beats are reduced and arcing is reduced between the neighboring pairs of electrodes.

In another aspect, a HF plasma excitation arrangement includes at least two HF power generators that are driven by means of a HF power generator drive system as described above.

The HF plasma excitation arrangements can be of the kind such as is used, for example, in FPD-manufacturing at frequencies of 3.39 MHz and multiples thereof. Furthermore, such HF plasma excitation arrangements can be coating systems in the range of 10 kHz to 1 MHz, in which multiple pairs of electrodes are arranged in direct proximity and in which the output signals of neighboring generators are synchronized and the phase position of which are set relative to one another.

Further features and advantages are obtained from the following description with reference to the Figures in the drawings, which show details, and from the claims. The features mentioned above and below can be utilized individually or collectively in arbitrary combination. The embodiments shown and described are not to be understood as exhaustive enumeration but have exemplary character for describing the invention

DESCRIPTION OF DRAWINGS

Like reference symbols in the various drawings indicate like elements.

DETAILED DESCRIPTION

Figure 1:
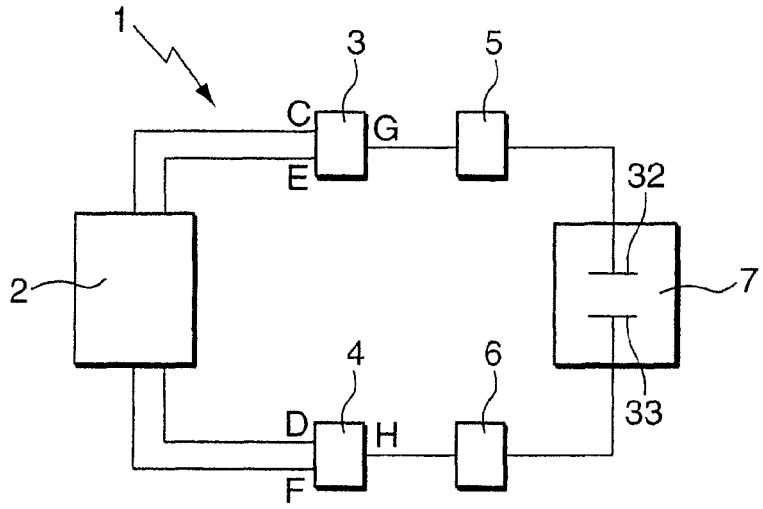
FIG. 1 is a block diagram of a HF plasma excitation arrangement.
Figure 6A:
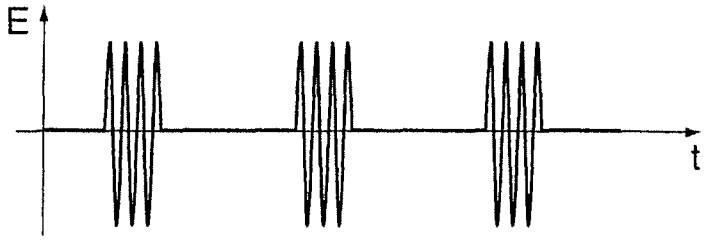
FIGS. 6*a* and 6*b* are illustrations of signal shapes of pulsed output HF signals.
Figure 6B:
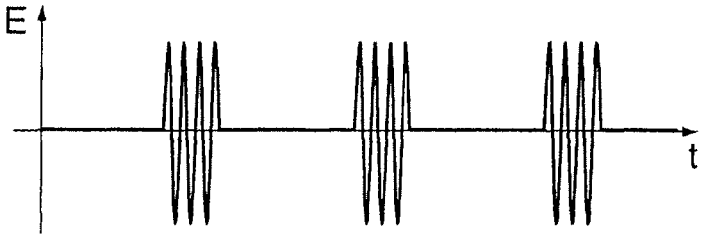

FIG. 1 shows a HF plasma excitation arrangement 1, which includes a HF power generator drive system 2. In the exemplary embodiment of FIG. 1, the HF power generator drive system 2 generates two drive signals C, D and two pulse signals E, F for a first and a second HF power generator 3, 4. Based on these signals, the HF power generators 3, 4 generate pulsed HF power signals G, H at their outputs, examples of which are shown in FIGS. 6*a* and 6*b*.

Figure 7A:
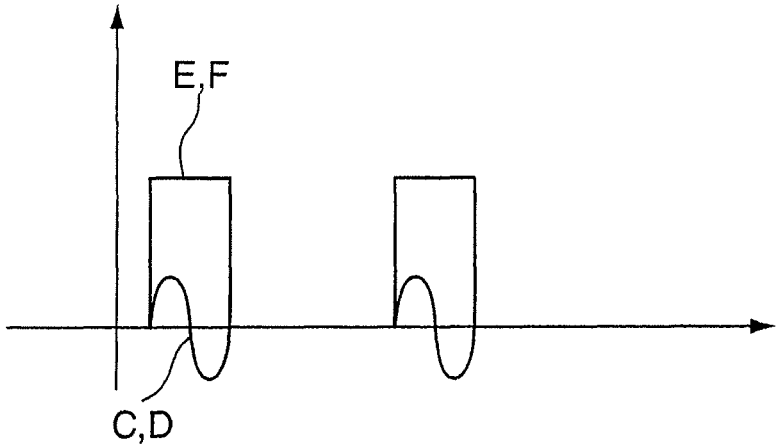
FIGS. 7*a* and 7*b* are illustrations of exemplary diagrams illustrating a drive signal synchronized with a pulse signal and a drive signal asynchronous to a pulse signal, respectively.

As shown in FIG. 7*a*, the pulse signals E, F can be synchronized with the drive signals C, D. This means that the phase position of the fundamental frequency (drive signal) is set in a fixed relationship to the phase of the pulse signal. The phase relationship therefore remains constant.

Figure 7B:
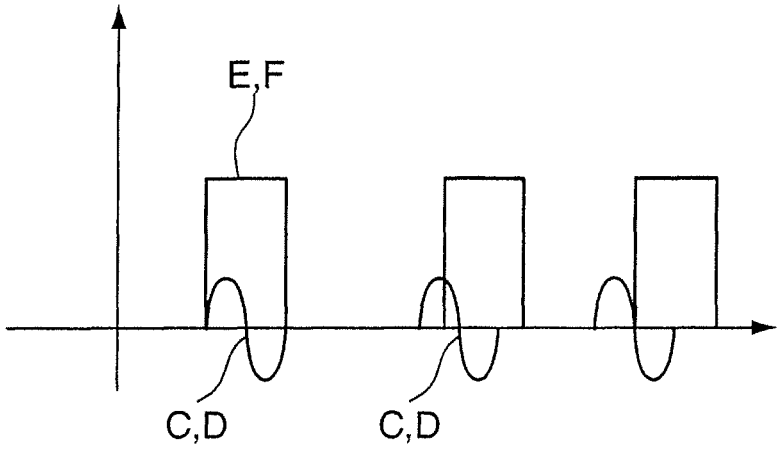

FIG. 7*b* shows the other possible case, where the drive signal C and the pulse signal E are asynchronous, i.e., the phase relationship changes.

The pulsed HF power signals G, H are provided by a matching network 5, 6 to electrodes 32, 33 of a plasma chamber 7. By supplying HF power from the two HF power generators 3, 4, a plasma process is carried out in the plasma chamber 7. As illustrated in the exemplary embodiment of FIG. 2*a*, the HF power generator drive system includes two drive signal generator arrangements 10, 11 for generating the drive signals. Using a processor 12, one can specify which type of drive signal is to be generated by the drive signal generator arrangements 10, 11. In particular, the frequency and phase of the drive signal are specified. On the basis of this specification, a signal is generated in digital function generators 13, 14. An exemplary signal is illustrated in FIG. 3 by a signal A corresponding to the signal at point A of FIG. 2. As signal A is generated digitally, it is in step-shaped form. The signal A is fed to a filter device 15 (or 16 as appropriate), in which a smoothing operation takes place, so that, for example, a sinusoidal signal B is generated. The signal B can then be fed to a comparator 17, 18, which, based on signal B, generates a square wave signal. An example signal C is shown in FIG. 3.

Figure 2A:
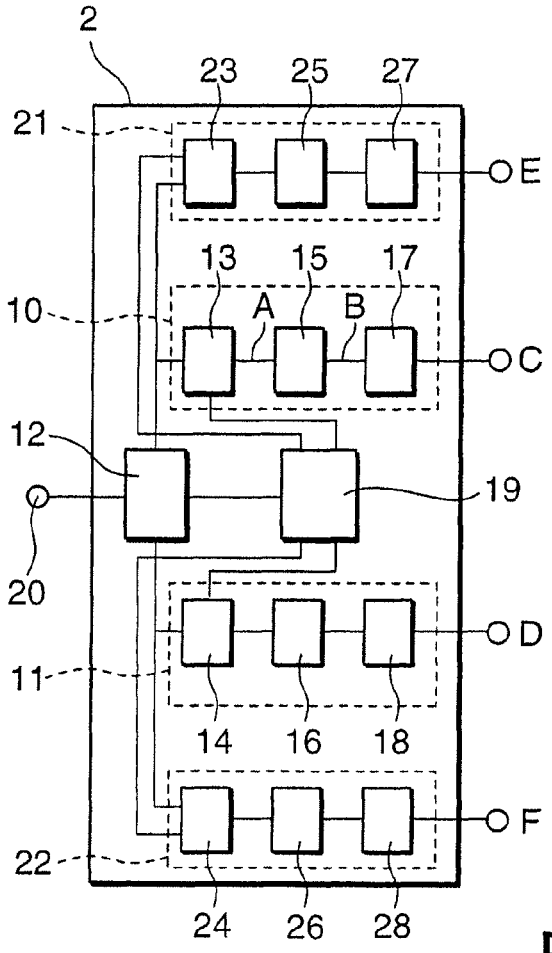
FIG. 2*a* is a block diagram of a first embodiment of an HF power generator drive system that can be used in the HF plasma excitation arrangement of FIG. 1.
Figure 3:
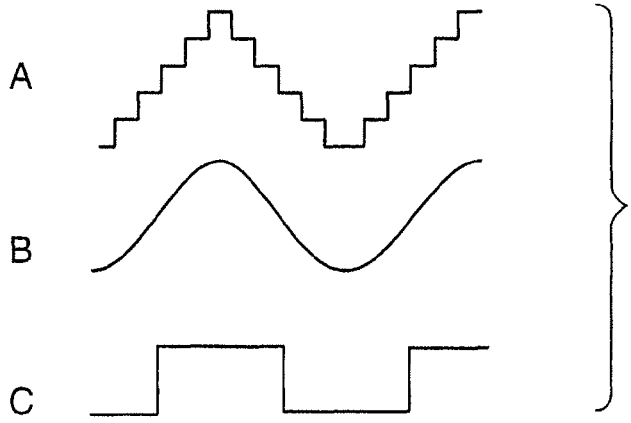
FIG. 3 is an illustration of signal traces at the points A, B, C of FIGS. 2*a* and 2*c;*

The HF power generator drive system 2 of FIG. 2*a* includes two additional pulse signal generator arrangements 21, 22 for generating pulse signals. With the processor 12, it can be specified which type of pulse signal is to be generated by the pulse signal generator arrangements 21, 22. In particular, the frequency and phase of the pulse signal are specified. Based on the specification, signals are generated in digital function generators 23, 24. The signals are fed to a filter device 25 or 26 as appropriate, in which a smoothing takes place, so that for example a sinusoidal signal is generated. This can then be fed to a comparator 27, 28, which generates a square wave signals from it.

Figure 2B:
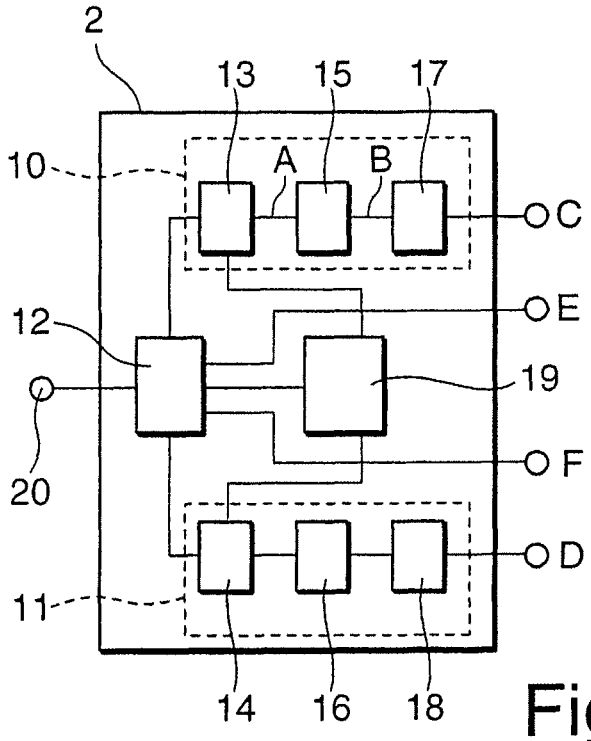
FIG. 2*b* is a block diagram of a second embodiment of an HF power generator drive system that can be used in the HF plasma excitation arrangement of FIG. 1.

The HF power generator drive system 2 of FIGS. 2*a* and 2*b* additionally includes an oscillator 19, which provides a common clock. In particular, the oscillator 19 supplies its clock to the digital function generators 13, 14, 23, 24 and to the processor 12. In the exemplary embodiment, the digital function generators 13, 14, 23, 24 can be implemented as so-called DDS. In order to be able to influence the generation of the drive signals and pulse signals, interfaces 20 can be provided, only one of which is shown in FIG. 2. It is thereby possible, for example, to provide a user the possibility to set or modify the phase setting and/or the frequency of the drive signals and the pulse signals. Supplied by the interface 20 to the processor 12, an input signal in the range of 0-5 V can, for example, be mapped on to a phase in the range of 0-360°. It is also possible, however, that a given voltage range is mapped on to a frequency in the range of 10 kHz-300 MHz or on to a range of multipliers, by which a fundamental frequency of, for example, 3.39 MHz is multiplied. Alternatively, a specified voltage range can be mapped on to integer divisors, by which a given fundamental frequency of, for example, 27.12 MHZ is divided.

In the embodiment of FIG. 2*b* (in contrast to the embodiment of FIG. 2*a*), there are no separate pulse signal generator arrangements provided. The function of a pulse signal generator arrangement is assumed by the processor 12 (micro processor), that directly generates the pulse signals E, F.

Figure 2C:
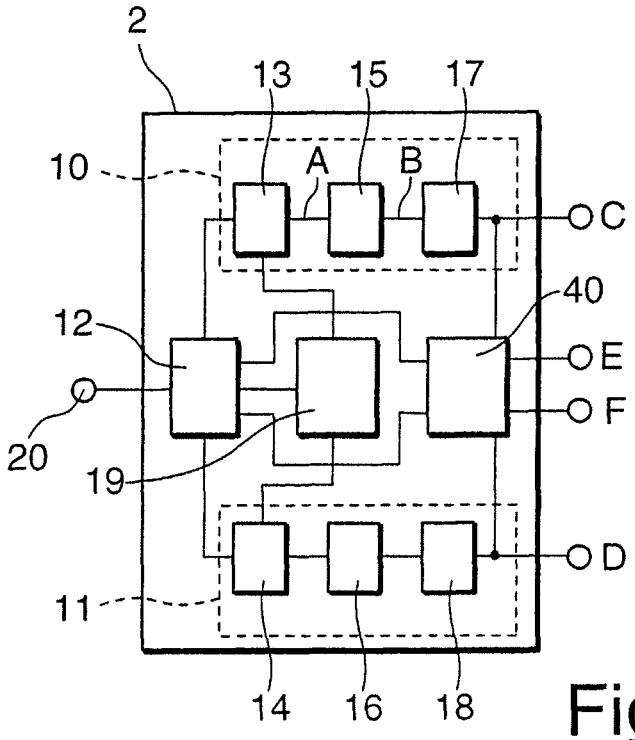
FIG. 2*c* is a block diagram of a third embodiment of an HF power generator drive system that can be used in the HF plasma excitation arrangement of FIG. 1.

In the embodiment of FIG. 2*c*, a programmable logic component 40 is additionally provided in the form of an FPGA. The pulse signals generated by the processor 12 and the drive signals C, D are fed to the programmable logic component 40. By means of the logic component 40 the pulse signals are synchronized with the drive signals C, D, so that synchronized pulse signals E, F are present at the outputs of the logic component 40.

Figure 4A:
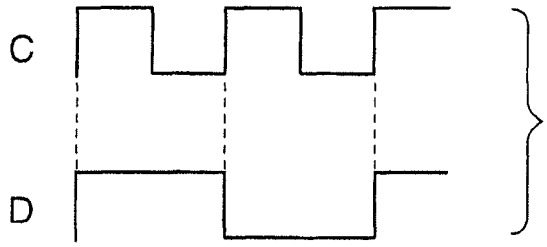
FIGS. 4*a*-4*c* are illustrations of exemplary combinations of drive signals.
Figure 4B:
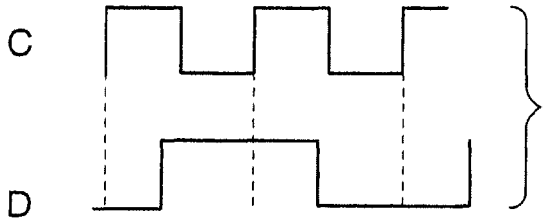
Figure 4C:
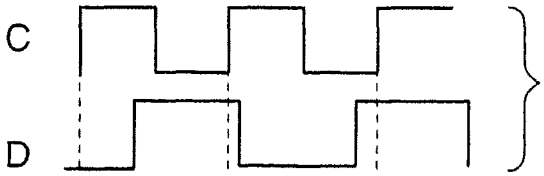
Figure 5A:
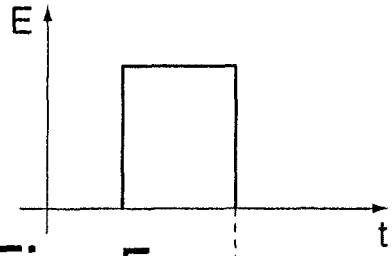
FIGS. 5*a*-5*d* are illustrations of exemplary pulse signals.
Figure 5B:
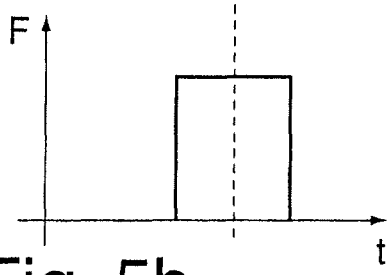
Figure 5C:
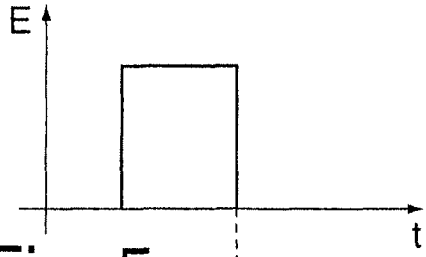
Figure 5D:
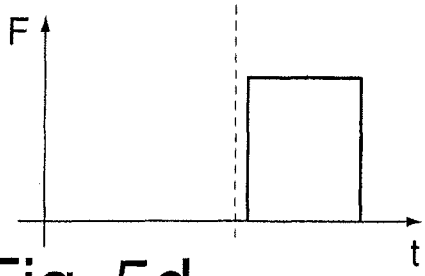

In FIGS. 4*a* to 4*c*, various shapes for drive signals C, D are shown. In FIG. 4*a*, the signals C, D are synchronized with each other, whereby the drive signal C has twice the frequency of the drive signal D. In FIG. 4*b*, the signals C, D have the same frequency relation as in FIG. 4*a*, i.e., signal C has twice the frequency of signal D, however, signal D is phase-shifted relative to signal C. In FIG. 4*c*, signals C, D have different frequencies and no specific phase relationship. In particular, signal D has a frequency that differs from that of signal C. Neither of signals C, D is an integral multiple of the respective other signal C, D.

In FIGS. 5*a* to 5*d*, exemplary pulse signals E, F are shown as they can exist at points E, F of FIG. 2. It should be noted here that the pulse signals E, F of FIGS. 5*a* and 5*b* overlap, whereas between the falling and rising edge of signal E of FIG. 5*c* and the rising edge of signal F of FIG. 5*d* there is a gap, so that these signals do not overlap.

The invention has been explained based on two HF power generators and two drive signals C, D and two pulse signals E, F. It is obvious that HF power generator drive systems 2 can be equipped with more than two drive signal generation arrangements 10, 11 and more than two pulse signal generation arrangements 21, 22, in order to generate correspondingly more drive signals C, D and pulse signals E, F, which in terms of frequency and phase can stand in different relationships to one another.

A number of embodiments of the invention have been described. Nevertheless, it will be understood that various modifications may be made without departing from the spirit and scope of the invention. Accordingly, other embodiments are within the scope of the following claims.

What is claimed is:

1. A method for supplying a plasma process with HF power, the method comprising:

providing at least two HF power generators, generating at least one drive signal having a user selectable frequency, generating at least one pulse signal, and based on the at least one drive signal and the at least one pulse signal, generating a pulsed HF power signal by each of the at least two HF power generators.

2. The method of claim 1, further comprising:

for the at least one pulse signal, adjusting at least one parameter selected from a group consisting of a pulse-frequency parameter, a duty-cycle parameter, and a phase-position parameter .

3. The method of claim 1, further comprising:

adjusting a phase relationship or a frequency relationship of pulse signals assigned to different HF power generators.

4. The method of claim 1, wherein a pulse frequency of the pulsed HF power signal of one of the HF power generators is smaller than a frequency of a drive signal assigned to the same HF power generator.

5. The method of claim 1, wherein a pulse frequency of one of the HF power generators is set synchronously or asynchronously to a frequency of a drive signal assigned to the same HF power generator.

6. The method of claim 1, wherein a drive signal is generated for each HF power generator.

7. The method of claim 1, wherein at least two drive signals are generated, and the method further comprising:

setting a predetermined phase or frequency relationship between the at least two drive signals.

8. The method of claim 1, wherein at least two drive signals or pulse signals have different frequencies.

9. The method of claim 1, further comprising adjusting the at least one drive signal or the at least one pulse signal via at least one digital interface of a HF power generator drive system.

10. The method of claim 1, further comprising adjusting the at least one drive signal or the at least one pulse signal via a programmable logic component.

11. The method of claim 1, further comprising selecting a frequency of the at least one drive signal to be an integral multiple of a frequency between 1 MHz and 6 MHZ.

12. The method of claim 1, wherein the at least one drive signal or the at least one pulse signal are each generated using a function generator.

13. The method of claim 12, further comprising driving the function generator by a common clock frequency.

14. A method for generating a pulsed HF power signal for supplying a plasma process with HF power, the method comprising:

providing at least two HF power generators, providing at least one drive signal having a user selectable frequency, providing at least one pulse signal, and based on the at least one drive signal and the at least one pulse signal, generating the pulsed HF power signal by each of the at least two HF power generators.

15. HF power generator drive system, comprising:

at least three signal generators configured to generate drive and pulse signals, wherein the at least three signal generators include at least one drive-signal generator configured to generate at least one drive signal having a user selectable frequency, and at least one pulse-signal generator configured to generate a pulse signal.

16. The HF power generator drive system of claim 15, wherein at least two pulse-signal generators are arranged in the HF power generator drive system.

17. The HF power generator drive system of claim 15, wherein at least one of the three signal generators includes a digital function generator.

18. The HF power generator drive system of claim 17, wherein the digital function generator includes a direct digital synthesizer.

19. The HF power generator drive system of claim 17, wherein at least one of the three signal generators includes a filter device connected to a load side of the digital function generator.

20. The HF power generator drive system of claim 15, wherein at least one of the at least three signal generators includes a comparator configured to generate the respective drive signal or pulse signal.

21. The HF power generator drive system of claim 15, further comprising:

a processor configured to drive at least one of the at least three signal generators.

22. The HF power generator drive system of claim 21, wherein the processor is configured to generate one or more pulse signals.

23. The HF power generator drive system of claim 21, further comprising:

an oscillator configured to generate a clock signal, which is connected to at least one of the at least three signal generators or the processor.

24. HF power generator drive system of claim 15, further comprising:

a programmable logic component.

25. Arrangement for HF plasma excitation, comprising:

a HF power generator drive system of claim 15, and at least two HF power generators, connected to and driven by the HF power generator drive system.

* * * * *